US006227815B1

(12) United States Patent
Chandra et al.

(10) Patent No.: US 6,227,815 B1
(45) Date of Patent: May 8, 2001

(54) PRESSURE CONTROL FOR A RECIPROCATING COMPRESSOR

(75) Inventors: Johan B. Chandra, Cincinnati; Joseph A. Abt, Harrison, both of OH (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 0 days.

(21) Appl. No.: 09/345,181

(22) Filed: Jun. 30, 1999

(51) Int. Cl.[7] ..... F09B 49/00
(52) U.S. Cl. ..... 417/298; 417/313
(58) Field of Search ..... 417/28, 493, 498, 417/313, 417, 237, 279, 380, 295; 418/84; 126/247; 123/317

(56) References Cited

U.S. PATENT DOCUMENTS

| | | | | |
|---|---|---|---|---|
| 3,788,780 | * | 1/1974 | Chomczyk et al. | 417/493 |
| 3,844,686 | | 10/1974 | LeBlanc . | |
| 3,844,688 | * | 10/1974 | Bulkley et al. | 417/313 |
| 3,930,762 | | 1/1976 | Varga . | |
| 4,021,151 | * | 5/1977 | Barthalon | 417/417 |
| 4,035,114 | * | 7/1977 | Sato | 418/84 |
| 4,060,340 | * | 11/1977 | Yanik et al. | 417/28 |
| 4,285,329 | * | 8/1981 | Moline | 126/247 |
| 4,478,556 | | 10/1984 | Gozzi . | |
| 4,536,132 | * | 8/1985 | Tenney | 417/237 |
| 4,993,922 | * | 2/1991 | Lauterbach et al. | 417/279 |
| 5,152,677 | | 10/1992 | Bauer et al. . | |
| 5,261,797 | * | 11/1993 | Christenson | 417/380 |
| 5,324,175 | | 6/1994 | Sorenson et al. . | |
| 5,377,634 | * | 1/1995 | Taue | 123/317 |
| 5,551,844 | | 9/1996 | Fujii et al. . | |
| 5,647,731 | * | 7/1997 | Onozawa | 417/295 |
| 5,653,876 | | 8/1997 | Funke . | |
| 5,688,110 | | 11/1997 | Djordjevic . | |
| 5,888,054 | | 3/1999 | Djordjevic . | |
| 6,055,959 | * | 5/2000 | Taue | 123/317 |

* cited by examiner

*Primary Examiner*—Philip H. Leung
*Assistant Examiner*—Leonid Fastovsky
(74) *Attorney, Agent, or Firm*—Jones, Day, Reavis & Pogue

(57) ABSTRACT

A reciprocating compressor apparatus includes a piston and a drive mechanism configured to reciprocate the piston. A housing contains a lubricant for the drive mechanism in a lubricant chamber at one side of the piston. The apparatus further includes a conduit pneumatically communicating the lubricant chamber with an opposite side of the piston, a check valve that prevents flow from the intake plenum to the lubricant chamber, and an inlet valve that acts as a throttling device to reduce the pressure in the inlet plenum.

2 Claims, 2 Drawing Sheets

PRESSURE CONTROL FOR A RECIPROCATING COMPRESSOR

BACKGROUND OF THE INVENTION

The present invention is directed to the field of compressors, and is particularly directed to reciprocating compressors.

There are three types of capacity controls that are common to reciprocating and other positive-displacement compressors. In a smaller compressor, a pressure switch is utilized to start and stop the motor in response to changes in discharge pressure. In a medium size compressor a constant speed control is often used in combination with the pressure switch. Constant speed control may be accomplished by throttling the intake of the compressor. Other capacity control techniques which involve changing the clearance volume or modifying the port timing of the compressor are also in use for rotary compressors. Large reciprocating compressors use capacity variation techniques based on disabling the compression process by opening the cylinder inlet or outlet valves. For a compressor driven by a variable-speed motor or engine, the speed of the motor or engine can be varied to control the capacity of the compressor.

The technique of throttling the intake has not been applicable to lubricated reciprocating compressors, which use one or more pistons to drive a compressed gas flow. By throttling the intake, the gas pressure at the top of the piston would be lower than the crankcase pressure, which could allow oil to migrate from the crankcase to the top of the piston. Such migrating oil could become entrained into the compressed gas.

In order to prevent pressure buildup inside the lubricant chamber, all reciprocating compressors are equipped with a vent or breather system. Some reciprocating compressors have a vent that is connected to the inlet plenum by means of a conduit which may include a check valve. Other compressors have a vent, with or without a check valve, that is open to the surrounding atmosphere.

SUMMARY OF THE INVENTION

In accordance with the present invention, a reciprocating compressor apparatus includes a piston and a drive mechanism configured to reciprocate the piston. A housing contains a lubricant for the drive mechanism in a lubricant chamber at one side of the piston. The apparatus further includes a conduit pneumatically communicating the lubricant chamber with an opposite side of the piston, a check valve that prevents flow through the conduit from the intake plenum to the lubricant chamber, and an intake valve that acts as a throttling device to reduce the pressure in the inlet plenum.

In a preferred embodiment of the present invention, the apparatus further includes a pilot valve or other operator. The intake valve is operative to control intake gas flowing to the intake plenum and piston. The pilot valve or operator sends a signal to the intake valve in response to a pneumatic fluid pressure output from the compressor. The intake valve reduces the flow of gas into the intake plenum if the compressor output pressure is rising.

DESCRIPTION OF A PREFERRED EMBODIMENT

Figure 1:
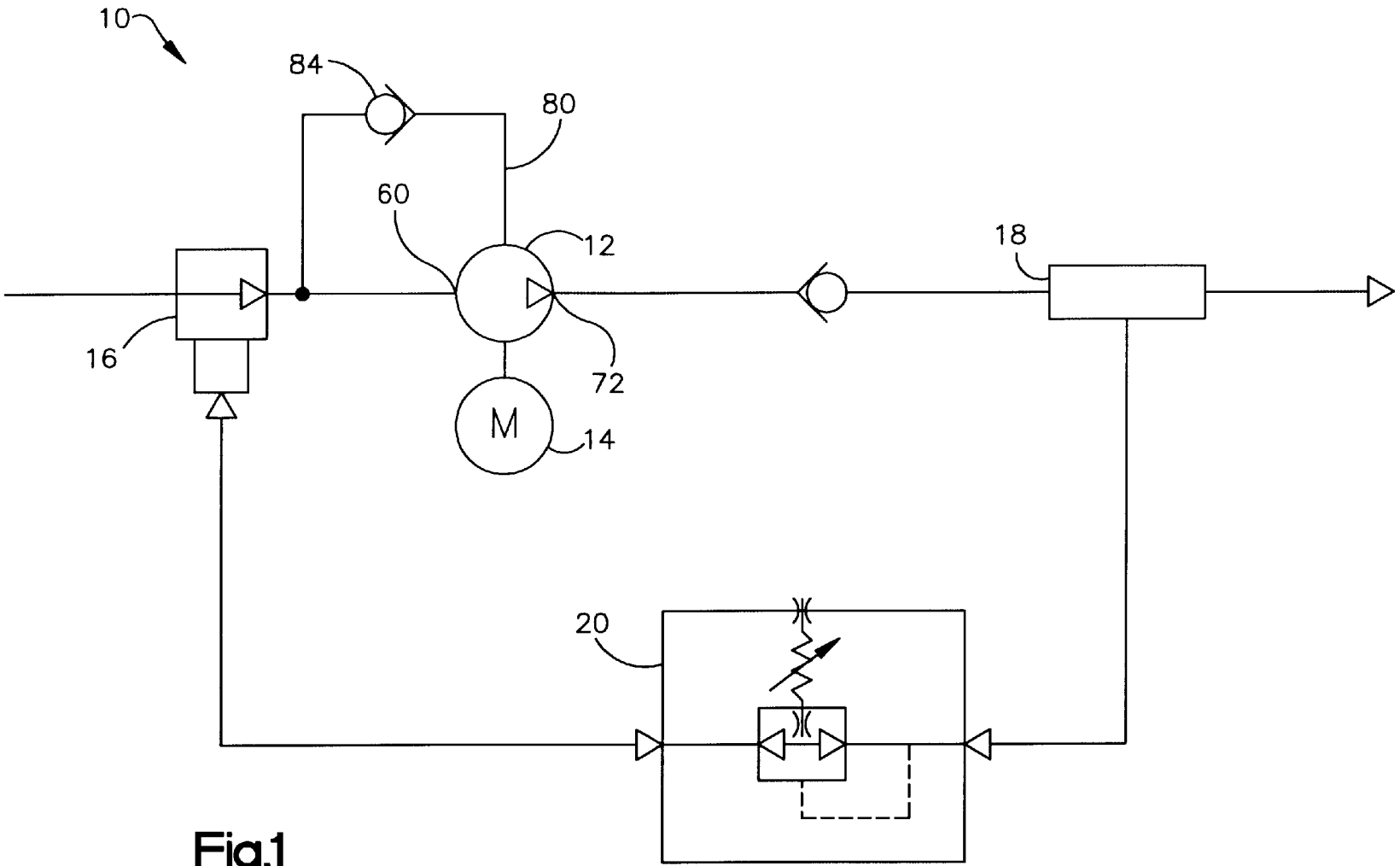
FIG. 1 is a schematic view of a compressor system comprising a preferred embodiment of the invention.

An apparatus 10 comprising a preferred embodiment of the present invention is shown schematically in FIG. 1. The apparatus 10 is a compressor system including a reciprocating compressor 12 which is driven by a motor 14. The compressor 12 draws gas, such as air, through an intake valve 16, into an intake plenum, compresses the gas, and delivers the compressed gas to a tank 18 at an elevated pressure. A pilot valve 20 operates in a known matter to send a signal to the intake valve 16 in response to the pressure in the tank 18. More specifically, the pilot valve 20 causes the intake valve 16 to constrict, and thereby to reduce the flow of gas being driven through the compressor 12, when the pressure in the tank 18 meets or exceeds a specified level. Such throttling of the intake valve 16 helps to ensure that the pressure in the tank 18 remains at or below the specified level. In accordance with the present invention, the compressor 12 is compressor is configured to accommodate pneumatic fluid pressure differentials that arise within the compressor 12 upon throttling of the intake valve 16.

Figure 2:
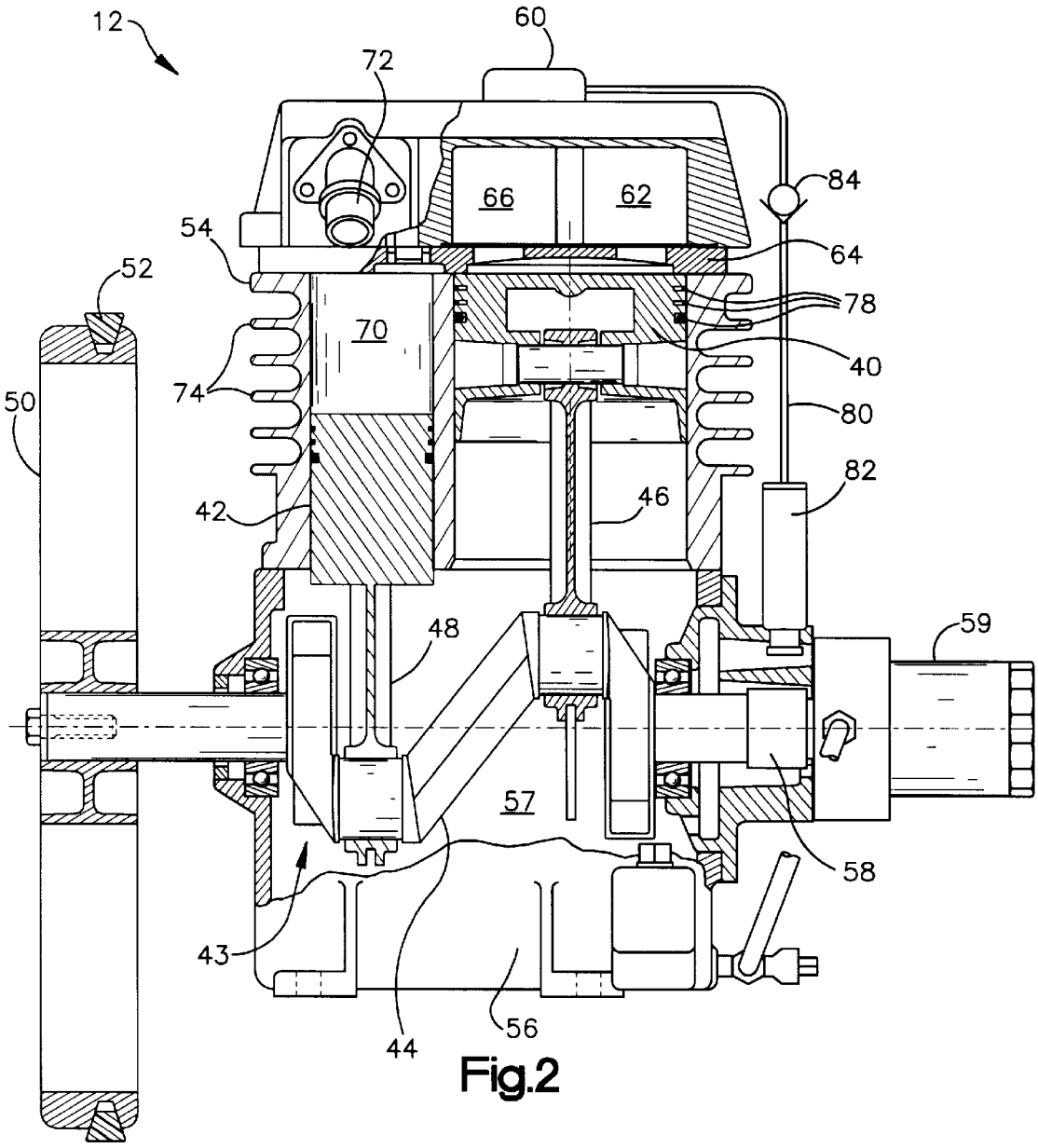
FIG. 2 is a side sectional view of the compressor shown in FIG. 1.

As shown in greater detail in FIG. 2, the compressor 12 in the preferred embodiment of the invention is a two-stage compressor including a first piston 40 and a second piston 42. Gas is initially compressed by the first piston 40 in the first stage, and is further compressed by the second piston 42 in the second stage. The pistons 40 and 42 are reciprocated by a drive mechanism 43 including a crankshaft 44 and a pair of connecting rods 46 and 48 that connect the pistons 40 and 42 to the crankshaft 44. A flywheel 50 for rotating the crankshaft 44 is connected to the motor 14 (FIG. 1) by a drive belt 52.

The compressor housing 54 includes a crankcase 56 containing a lubricant, which preferably consists of oil, for the parts of the drive mechanism 43 that rotate and reciprocate within the housing 54. The housing 54 thus defines a lubricant chamber 57 containing both oil and gas at the lower sides of the pistons 40 and 42. An oil pump 58 circulates the oil through the chamber 57 and an oil filter 59.

In operation of the system 10 (FIG. 1), gas from the intake valve 16 is drawn into the compressor 12 through an inlet port 60. The gas first enters an inlet chamber 62 (FIG. 2), and is then drawn downward, as viewed in FIG. 2, toward the first piston 40 through a valve plate 64. As known in the art, the valve plate 64 includes a inlet or suction valve that opens to permit the gas to flow downward through the valve plate 64 upon retraction of the piston 40 from the valve plate 64, and further includes an outlet or discharge valve that opens to permit the compressed gas to flow upward through the valve plate 64 upon movement of the piston 40 back upward toward the valve plate 64. The compressed gas flowing upward through the valve plate 64 enters a discharge plenum 66. Upon this first stage of compression, the pressure in the discharge plenum 66 reaches a first elevated level of, for example, about 45 psi.

The space 70 above the second piston 42 communicates with the discharge plenum 66. Accordingly, upon second stage compression, the pressure in the discharge plenum 66 is further raised to a second elevated level of, for example, about 175 psi. A discharge valve (not shown) at the location discharges the compressed gas through a discharge port 72 in a known manner. During these two successive compression stages, the temperature within the compressor 12 can become as high as 375° F. or more. Cooling fins 74 are provided on the outside of the compressor housing 54 to dissipate heat and reduce the discharge gas temperature.

When the compressor 12 operates in the foregoing manner, the pressure at the upper side of the first piston 40 is lower than the pressure upstream of the intake valve 16 during the intake stroke. Since the pressure in the lubricant chamber 57 is at or near the pressure upstream of the intake valve 16, a pneumatic fluid pressure differential develops across the first piston 40 during the intake stroke, with the greater pressure being located at the lower side of the piston 40. This pressure differential is even greater at times when the pressure at the intake port 60 is reduced by throttling of the intake valve 16 (FIG. 1) under the influence of the pilot valve 20. If this pressure differential were to reach an excessively high level, it could force the oil to migrate upward past the piston seals 78. Such oil could be entrained into the gas flowing through the compressor 12. Therefore, in accordance with the present invention, the compressor 12 is configured so that the pressure differential acting across the first piston 40 will not cause oil to migrate upward past the piston seals 78.

A fluid conduit 80 pneumatically communicates the lubricant chamber 57 with the intake port 60. A crankcase breather 82 at the crankcase end of the conduit 80 contains a mesh or baffle arrangement that blocks the passage of oil but allows gas to pass from the lubricant chamber 57 to the conduit 80. A check valve 84 opens to allow gas to pass through the conduit 80 from the lubricant chamber 57 to the intake port 60 when the pressure differential acting across the check valve 84 reaches a predetermined elevated level. That level indicates that the corresponding pressure differential acting across the first piston 40 is approaching a level that could force oil upward past the seals 78. This relieves the pressure differential acting across the first piston 40 to help ensure that oil does not become entrained into the gas flowing through the compressor 12. The check valve 84 prevents gas from returning to the lubricant chamber during the upward stroke of the piston 40 so that the pressure differential is not reestablished on subsequent downward strokes. When gas from leakage downward past the piston seals 78 accumulates in sufficient quantity to raise the pressure differential, the conduit 80 and check valve 84 act again to prevent detrimental levels from being established.

The present invention has been described with reference to a preferred embodiment. Those skilled in the art will perceive improvements, changes, and modifications as taught by the foregoing description. Such improvements, changes and modifications are intended to be covered by the appended claims.

We claim:

1. An apparatus comprising:

a piston;

an intake valve operative to control intake gas flowing to said piston;

a drive mechanism configured to reciprocate said piston;

a housing containing a lubricant for said drive mechanism in a lubricant chamber at one side of said piston;

a conduit pneumatically communicating said lubricant chamber with an opposite side of said piston; and a check valve arranged to block gas from flowing through said conduit from said opposite side of said piston to said lubricant chamber, and to open to permit gas to flow through said conduit from said lubricant chamber to said opposite side of said piston when the pneumatic pressure in said lubricant chamber reaches a predetermined elevated level.

2. An apparatus as defined in claim 1 further comprising a tank arranged to receive compressed gas from said opposite side of said piston, and a pilot valve operative to throttle said intake valve in response to pneumatic pressure in said tank.

* * * * *